United States Patent [19]

Kanatani et al.

[11] Patent Number: 4,553,929

[45] Date of Patent: Nov. 19, 1985

[54] HEATING FURNACE

[75] Inventors: Tadayuki Kanatani; Yasuo Sakata, both of Yokohama, Japan

[73] Assignee: Kabushiki Kaisha Toshiba, Japan

[21] Appl. No.: 615,905

[22] Filed: May 31, 1984

[30] Foreign Application Priority Data

Dec. 16, 1983 [JP] Japan ..... 58-192899[U]

[51] Int. Cl.[4] ..... F27B 9/28

[52] U.S. Cl. ..... 432/59; 432/8

[58] Field of Search ..... 432/8, 59, 178, 179, 432/223; 34/86, 156

[56] References Cited

U.S. PATENT DOCUMENTS

| | | | |
|---|---|---|---|
| 2,880,739 | 4/1959 | Popp | 432/59 |
| 3,744,961 | 7/1973 | Eguchi et al. | 432/59 |
| 3,874,091 | 4/1975 | Fukumoto | 432/59 |
| 4,255,136 | 3/1981 | Suzuki et al. | 432/143 |

FOREIGN PATENT DOCUMENTS 56179474 6/1983 Japan .

*Primary Examiner*—Henry C. Yuen

*Attorney, Agent, or Firm*—Cushman, Darby & Cushman

[57] ABSTRACT

A heating furnace for heating elongate materials has a cylindrical furnace body whose both ends are closed by first and second end walls. The furnace body has an exhaust port formed near the first end wall. A material to be heated is inserted into the furnace body through penetrating holes formed in the end walls. A plurality of furnace core tubes are arranged in the body at a prescribed distance from the inner peripheral surface of the body and along the axis of the body. A heating chamber is defined by the inner surfaces of the core tubes. An air-gas passage is defined between the inner peripheral surface of the furnace body and the outer peripheral surfaces of the core tubes. The air-gas passage communicates with the heating chamber through a communication passage formed in the core tube adjacent to the second end wall. Combustion gas ejected from ejection nozzles which are formed in the first end wall is supplied into the heating chamber and then discharged from the exhaust port through the communication passage and air-gas passage.

13 Claims, 3 Drawing Figures

GASS
AIR

HEATING FURNACE

BACKGROUND OF THE INVENTION

This invention relates to a furnace intended for the heat treatment of elongate materials such as wire, rod, ribbon and the like, particularly materials with a high melting point such as tungsten or molybdenum.

A conventional heating furnace for quickly heating elongate materials, for example, wires at a high temperature is the type which comprises a cylindrical furnace, a plurality of burners arranged around the peripheral wall of the furnace and a plurality of exhaust ports formed in the peripheral wall of the furnace so as to face the plural burners. With this type of heating furnace, wire is directly heated by the flames of the burner while it travels through the furnace and exhaust gas is discharged from the exhaust ports. However, the heating furnace known to date has the drawback that its inside space is not effectively utilized. In other words, the heat supplied from the burners is immediately drawn off to the open air through the exhaust ports, and is retained in the furnace only for a short length of time. Therefore, the heat fails to be fully utilized resulting in an uneconomical operation. A further problem with the conventional furnace is that since the flames of the burner directly touch the wire, the surface of the wire is oxidized, leading to the deterioration of its quality.

To resolve the above-mentioned drawbacks, another heating furnace has been proposed which is so designed that a combustion gas is carried into a cylindrical furnace body from a burner arranged at one end of the furnace body. The combustion gas heats the wire held in the furnace body and is drawn off through an exhaust port provided at the opposite end of the furnace body. This proposed heating furnace offers the advantage that heat is retained for a longer length of time in the furnace body than in the above-mentioned conventional furnace. When said proposed furnace is applied to the heat treatment of wires having a high melting point such as tungsten or molybdenum, the interior of the furnace body can be heated to a temperature higher than 1,200° C. Therefore, the wall of the furnace body should be made sufficiently thick to withstand the thermal shock resulting from such a high temperature. In such case, however, the length of time required to heat the furnace body to a prescribed temperature is extended, leading to the consumption of the combustion gas. Moreover, the above-mentioned thick walled furnace is regarded as unadaptable for high heat efficiency and consequently is regarded as uneconomical.

SUMMARY OF THE INVENTION

This invention has been accomplished in view of the above circumstances, and is intended to provide an economical heating furnace capable of utilizing a combustion gas with high heat efficiency.

To attain the above-mentioned object, this invention provides a heating furnace which comprises:

a substantially cylindrical furnace body which is closed at both ends, and includes first and second end walls each having a through hole and an exhaust port formed near the first end wall, and wherein a material to be heated is inserted into the furnace body through the through holes;

tubular means which is arranged in the furnace body apart from the inner peripheral surface of the furnace body and extends along the axis of the furnace body and is provided with a heating chamber and defines an air-gas passage communicating with the exhaust port between the tubular means and the inner peripheral surface of the furnace body, the tubular means having one end contacting the first end wall of the furnace body and the other end being positioned near the second end wall of the furnace body and having a communication passage for effecting communication between the heating chamber and air-gas passage; and gas-feeding means which is built in the first end wall of the furnace body to conduct combustion gas from the one end of the tubular means to the heating chamber and then to the exhaust port through the communication passage and air-gas passage.

With this heating furnace according to the invention, the combustion gas flows through the heating chamber and then is drawn off to the outside through the air duct and the exhaust port. Therefore, the tubular means is heated by the combustion gas on both the inside and outside, and is heated to a prescribed temperature in a short time. The combustion gas is retained in the furnace body sufficiently long enough to have its heat fully utilized for the heating of a material to be heated. With the heating furnace embodying this invention which is of a double structure type having a furnace body and tubular means, the heat in the heating chamber has little chance to escape, thereby making it possible to reduce the thickness of the wall of the tubular means. This means that the heating time can be shortened, thereby ensuring the saving of combustion gas and an economic advantage.

DETAILED DESCRIPTION OF THE PREFERRED EMBODIMENTS

Figures 1, 2:
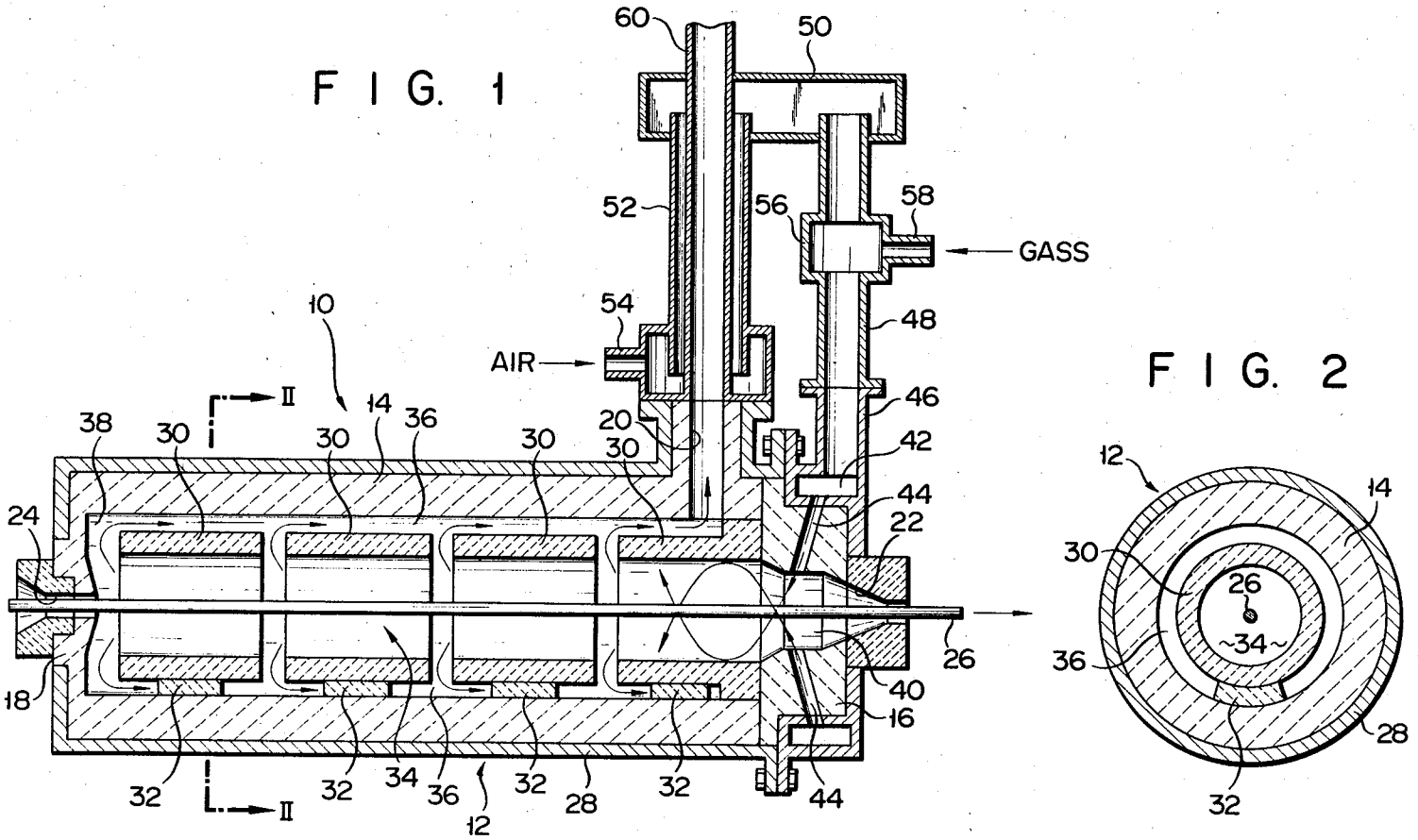
FIG. 1 is a longitudinal sectional view of a heating furnace according to a first embodiment of the invention.
FIG. 2 is a cross-sectional view taken along a line II—II of FIG. 1.

A description may now be made with reference to the accompanying drawings of a heating furnace embodying this invention. As seen from FIGS. 1 and 2, a heating furnace 10 according to a first embodiment of this invention is provided with a cylindrical furnace body 12 closed at both ends. The furnace body includes a cylindrical peripheral wall 14, a first end wall 16 closing the right end of the peripheral wall, and a second end wall 18 closing the left end of the peripheral wall. All the members 14, 16, 18 are made of refractory or heat-resistant material. In right end portion of the peripheral wall 14 is formed an exhaust port 20 effecting communication between the inside and outside of the furnace body 12. A through hole acting as an outlet port 22 is formed in the center of the first end wall 16. In the center of the second end wall 18 is formed a through hole acting as an inlet port 24. A wire 26 made of, for example, tungsten which is to be heated in the furnace 10 is inserted into the furnace body 12 through the inlet port 24 and outlet port 22. The first end wall 16 is formed separately from the peripheral wall 14 and is made detachable therefrom. The furnace body 12 is almost entirely covered with a casing 28.

A plurality of, for example, four cylindrical furnace core tubes 30 which are made of a refractory material are arranged in the furnace body 14. These core tubes 30 have the same inner and outer diameter. The core tubes 30 are concentrically arranged with the furnace body 12 at a prescribed distance from the inner peripheral surface thereof and placed along the axis of the furnace body 12 to be equidistant from each other. The furnace core tube 30 at the extreme right has its right edge attached to the first end wall 16. Similarly, the furnace core tube 30 at the extreme left has its left edge adjacent to the second end wall 18. Each core tube 30 is supported on the inner peripheral surface of the furnace body 12 by means of a support 32 made of a refractory material. Each core tube 30 is gravitationally held on the support 32, and can be taken out of the furnace body, if necessary.

The inner peripheral surfaces of the furnace core tubes 30 collectively define a heating chamber 34 for heating the wire 26. Further, the inner peripheral surface of the furnace body 12 and the outer peripheral surfaces of the furnace core tubes 30 jointly define an annular air-gas passage 36 which communicates with the exhaust port 20. A communication passage 38 for effecting communication between the heating chamber 34 and air-gas passage 36 is defined between the left end of the furnace core tube 30 positioned on the extreme left side, and the second end wall 18. The above-mentioned furnace core tubes 30 collectively constitute the tubular means of the wire-heating furnace embodying this invention.

The inner end portion of the outlet port 22 formed in the first end wall 16 has a widened diameter to define an ignition chamber 40 which communicates with the heating chamber 34. An annular air-gas mixture chamber 42 is formed around the outer peripheral wall of the first end wall 16. A plurality of (for example, two) ejection nozzles 44 extending from the air-gas mixture chamber 42 to the ignition chamber 40 are formed in the first end wall 16. A gas-air mixture is forcefully drawn from the nozzles 44 into the heating chamber 34 through the ignition chamber 40. The ejection nozzles 44 are inclined toward the second end wall 18 and also toward the diameter of the furnace body 12. Therefore, the gas-air mixture ejected from the ejection nozzles 44 flows from the right end to the left end of the heating chamber 34 while whirling around its axis. An air-gas mixture introducing tube 46 extends from the mixture chamber 42. An air inlet port 54 is connected to the introducing tube 46 through pipes 48, 50 and through the heat exchange 52. A gas-air mixing portion 56 is provided in the pipe 48. A gas inlet port 58 is formed at the mixing portion 56. An exhaust tube 60 is connected to the exhaust port 20. The heat exchanger 52 is built to surround the exhaust tube 60. Air drawn in through the inlet port 54 is conducted to the mixing portion 56 through the heat exchanger 52 and pipe 50. The air is mixed in the mixing portion 56 with a gas introduced through the gas inlet port 58. The air-gas mixture is then conducted to the air-gas mixture-introducing tube 46.

A description may now be made of the operation of the heating furnace 10 constructed as described above. An air-gas mixture entering the introducing tube 46 is forwarded to the ejection nozzles 44 through the air-gas mixture chamber 42. The mixture is ejected from the nozzles 44 through the ignition chamber 40 into the heating chamber 34. Thus, the mixture flows in a whirling state from the right end to the left end of the heating chamber 34 along the inner peripheral surface of the furnace core tubes 30. At this time, the air-gas mixture is ignited by, for example, an auxiliary burner. As a result, the air-gas mixture runs through the heating chamber 34 while gradually burning. The flames resulting from the ignition are also conducted through the heating chamber 34 in a whirling state. The combustion gas enters the air-gas passage 36 from the left end of the heating chamber 34 through the communication passage 38, and is then drawn off into the exhaust pipe 60 through the exhaust port 20. Part of the combustion gas flowing through the heating chamber 34 enters through the spaces between the adjacent furnace core tubes 30 into the air-gas passage 36. Thus the core tubes 30 are heated at both the outer and inner peripheral surfaces by the combustion gas flowing through the heating chamber 34 and air-gas passage 36.

After the interior of the heating chamber 34 reaches a prescribed temperature, a wire 26 is inserted into the furnace body 12 through the inlet port 24, is made to travel along the axis of the heating chamber 34, and is then drawn off to the outside from the outlet port 22. While carried through the heating chamber 34, the wire 26 is rapidly heated by the combustion gas flowing through the heating chamber and also by the heat radiating from the furnace core tubes 30. In this case, the flames and combustion gas move along the inner peripheral surfaces of the furnace core tubes 30 in a whirling state, and are prevented from directly touching the wire 26. Therefore, the wire 26 is saved from, for example, oxidation.

The heating furnace 10 constructed as described above offers the following advantages. The furnace core tubes 30 are heated on both the outside and the inside by the combustion gas flowing through the heating chamber 34 and air-gas passage 36. The core tubes 30 are also heated on both side edges by the combustion gas flowing through the spaces between the core tubes. Therefore, the core tubes 30 are uniformly heated to a prescribed temperature in a short time, even when the peripheral walls 14 do not retain certain amount of heat. The furnace 10 is a double structure type comprising a furnace body 12 and furnace core tubes 30. This construction offers the following advantages. Namely, the heat accumulated in the heating chamber is not likely to escape to the outside. Therefore, the wall of the respective furnace core tubes 30 can be appreciably reduced in thickness, thereby enabling the furnace core tubes 30 to be heated to a prescribed temperature in a short time and moreover to be heated uniformly. The shortening of the length of time required to heat the furnace core tubes 30 to a prescribed temperature ensures saving on the consumption of the combustion gas, thereby serving to elevate the economic merit of the subject heating furnace. Further, the uniform heating of the respective furnace core tubes 30 prevents the occurrence of thermal strains in the tubes 30 and ensures the elevation of their durability. When any of the furnace core tubes 30 is damaged, the first end wall 16 of the furnace body 12 is removed from the body 12, and then the defective furnace core tube 30 is removed from the furnace body and replaced with a fresh furnace core tube. Any of the furnace core tubes 30 which are not fixed to the furnace body 12 can be easily exchanged for a new one, thereby ensuring a considerable economic advantage.

Figure 3:
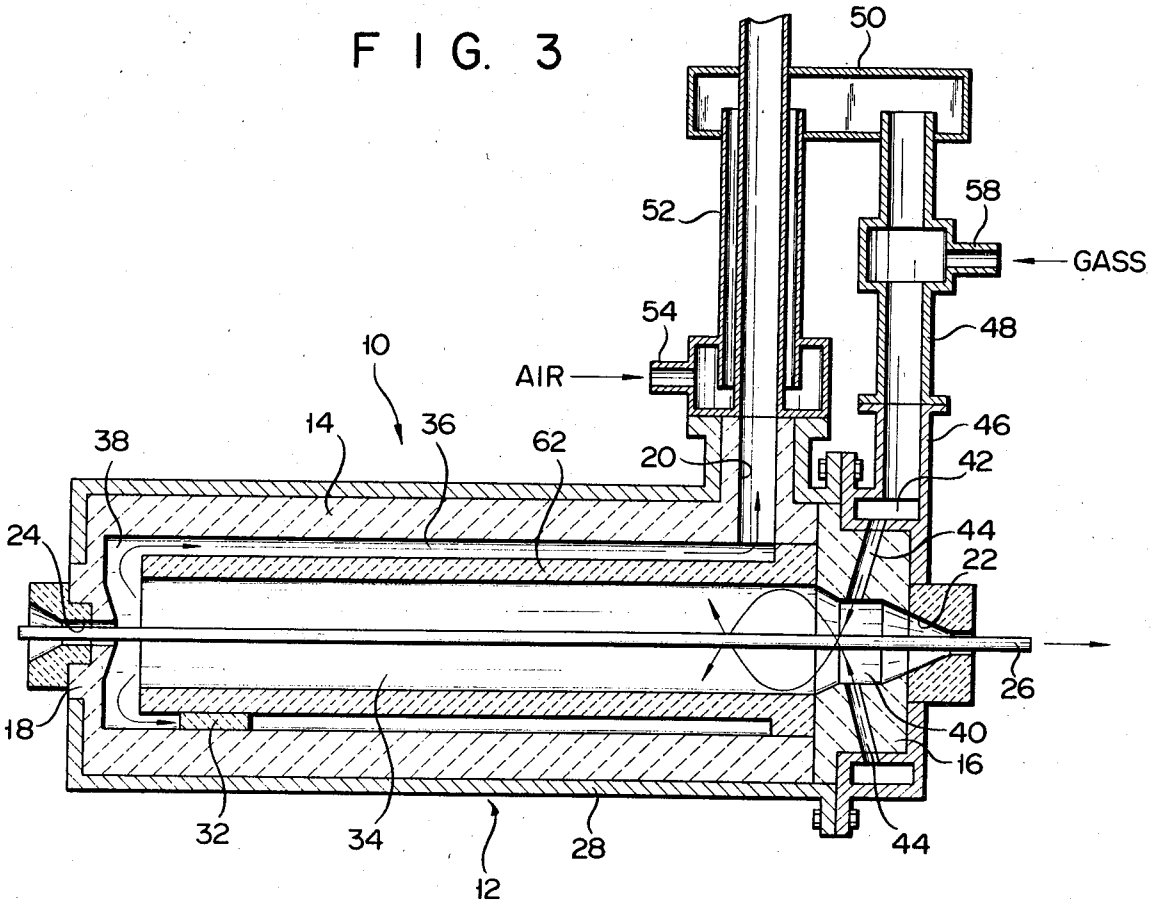
FIG. 3 is a longitudinal sectional view of a heating furnace according to a second embodiment of the invention.

It should be noted that this invention is not limited to the foregoing embodiment, but that the invention can be made with various changes and modifications without departing from the object and scope of the invention. For instance, though the tubular means of the aforementioned embodiment includes a plurality of furnace core tubes, it is possible for the tubular means to be built of a single furnace core tube as shown in FIG. 3. In the second embodiment of FIG. 3, too, the furnace core tube 62 is heated on both the outside and the inside by a combustion gas to have a prescribed temperature in a short time and to be uniform. The furnace according to the second embodiment of FIG. 3 which comprises only one furnace core tube 62 has a simple construction and can be manufactured at an appreciably low cost.

The parts of FIG. 3 that are the same as those of FIG. 1 are denoted by the same numerals, the description thereof being omitted.

What is claimed is:

1. A heating furnace comprising:

a cylindrical furnace body defining a cylindrical inner peripheral surface and including first and second end walls respectively defining inlet and outlet ports through which a material to be heated is inserted along an insertion path coaxial to said furnace body;

means defining an exhaust port formed near said first end wall through which a combustion gas is exhausted from said furnace body;

tubular means axially positioned in said furnace body, said tubular means defining an interior space which establishes a heating chamber and an outer peripheral surface which establishes, together with said inner peripheral surface of said furnace body, an annular air-gas passage in fluid communication with said exhaust port, one end of said tubular means being in contact with said first end wall while the other end of said tubular means is in spaced relationship to said second end wall and includes means establishing fluid communication between said heating chamber and said air-gas passage; and gas feeding means associated with said first end wall for feeding the combustion gas from said one end of said tubular means into said heating chamber, the combustion gas then flowing around said other end of said tubular means and into said air-gas passage to be exhausted through said exhaust port, wherein said gas feeding means includes (a) means defining an ignition chamber having a cylindrical side wall, and (b) means defining at least one injection nozzle having a discharge end opening into said ignition chamber and a feed end for introducing said combustion gas into said injection nozzle, said injection nozzle being inclined between said feed and discharge ends in a direction towards said second end wall and radially extending from said insertion path, wherein combustion gas injected into said ignition chamber impinges upon said side wall to effect a swirling motion thereto as said combustion gas flows through said heating chamber.

2. A heating furnace comprising:

a cylindrical furnace body closed at both ends and defining therebetween an inner peripheral surface, said furnace body including first and second end walls each having a penetrating hole and an exhaust port formed near the first end wall, and into which a material to be heated is inserted through the penetrating holes;

tubular means which is arranged in the furnace body at a prescribed interval from the inner peripheral surface of the furnace body and along the axis of the furnace body, said tubular means defining an interior to establish a heating chamber and an outer peripheral surface which defines, together with said inner peripheral surface of said furnace body, an air-gas passage communicating with the exhaust port, one end of the tubular means in contact with the first end wall of the furnace body, and the other end of the tubular means being positioned near the second end wall of the furnace body and provided with a communication passage effecting communication between the heating chamber and the air-gas passage; and gas feeding means which is included in the first end wall of the furnace body to conduct combustion gas from the one end of the tubular means to the heating chamber and then to forward the combustion gas to the exhaust port through the communication passage and air-gas passage, wherein said tubular means is formed of a single cylindrical furnace core tube having substantially the same length as the furnace body, and the heating chamber is defined by its own inner peripheral surface.

3. The heating furnace according to claim 2, wherein one end of said furnace core tube contacts the first end wall of the furnace body; the other end of tne furnace core tube is located adjacent to the second end wall of the furnace body to define the communication passage with the second end wall; and the exhaust port is formed in the peripheral wall of the furnace body.

4. The heating furnace according to claim 3, wherein said furnace core tube is positioned concentrically with the furnace body.

5. A heating furnace comprising:

a cylindrical furnace body closed at both ends and defining therebetween an inner peripheral surface, said furnace body including first and second end walls each having a penetrating hole and an exhaust port formed near the first end wall, and into which a material to be heated is inserted through the penetrating holes;

tubular means which is arranged in the furnace body at a prescribed interval from the inner peripheral surface of the furnace body and along the axis of the furnace body, said tubular means defining an interior to establish a heating chamber and an outer peripheral surface which defines, together with said inner peripheral surface of said furnace body, an air-gas passage communicating with the exhaust port, one end of the tubular means in contact with the first end wall of the furnace body, and the other end of the tubular means being positioned near the second end wall of the furnace body and provided with a communication passage effecting communication between the heating chamber and the air-gas passage; and gas feeding means which is included in the first end wall of the furnace body to conduct combustion gas from the one end of the tubular means to the heating chamber and then to forward the combustion gas to the exhaust port through the communication passage and air-gas passage, wherein said gas feeding means includes a cylindrical ignition chamber which is formed in the first end wall of the furnace body to be coaxial with the heating chamber and communicates with the heating chamber, and said gas feeding means further includes at least one ejection nozzle formed in the first end wall to open to the peripheral surface of the ignition chamber, the ejection nozzle extending along the tangential direction of the peripheral surface of the ignition chamber and being inclined toward the second end wall of the furnace body, and causing the combustion gas to be ejected in a whirling state toward the second end wall of the furnace body along the inner surface of the tubular means.

6. The heating furnace according to claim 5, wherein said tubular means includes a plurality of furnace core tubes having the same inner diameter and the same outer diamter, the furnace core tubes being arranged along the axis of the furnace body at a prescribed distance from each other, and the heating chamber being defined by the inner peripheral surfaces of the furnace core tubes.

7. The heating furnace according to claim 6, wherein one end of said furnace core tube which lies closest to the first end wall of the furnace body contacts the first end wall; the communication passage is defined between one end of the furnace core tube which lies closest to the second end wall of the furnace body and the second end wall thereof; and the exhaust port is formed in the peripheral wall of the furnace body.

8. The heating furnace according to claim 7, wherein said tubular means includes a plurality of supports which are arranged between the respective furnace core tubes and the furnace body to support the furnace core tubes on the inner peripheral surface of the furnace body.

9. The heating furnace according to claim 8, wherein said furnace core tubes are arranged concentrically with the furnace body.

10. The heating furnace according to claim 5, wherein said first end wall of the furnace body includes means for detachably mounting said first end wall to the furnace body thereby enabling the tubular means to be taken out of the furnace body.

11. The heating furnace according to claim 5, wherein said tubular means is formed of a single cylindrical furnace core tube having substantially the same length as the furnace body, and the heating chamber is defined by its own inner peripheral surface.

12. The heating furnace according to claim 11 wherein one end of said furnace core tube contacts the first end wall of the furnace body, the other end of the furnace core tube is located adjacent to the second end wall of the furnace body to define the communication passage with the second end wall; and the exhaust port is formed in the peripheral wall of the furnace body.

13. The heating furnace according to claim 12 wherein said furnace core tube is positioned concentrically with the furnace body.

* * * * *

UNITED STATES PATENT AND TRADEMARK OFFICE

CERTIFICATE OF CORRECTION

PATENT NO. : 4,553,929

DATED : November 19, 1985

INVENTOR(S) : Tadayuki KANATANI, Yasuo Sakata

It is certified that error appears in the above-identified patent and that said Letters Patent is hereby corrected as shown below:

On the title page

Change "[73] Assignee: Kabushiki Kaisha Toshiba, Japan" to --[73] Assignee: Kabushiki Kaisha Toshiba, Kawasaki, Japan--.

Signed and Sealed this

*Second* Day of *September 1986*

[SEAL]

*Attest:*

DONALD J. QUIGG

*Attesting Officer*

*Commissioner of Patents and Trademarks*